US006299547B1

(12) United States Patent
Kosmatka

(10) Patent No.: US 6,299,547 B1
(45) Date of Patent: Oct. 9, 2001

(54) GOLF CLUB HEAD WITH AN INTERNAL STRIKING PLATE BRACE

(75) Inventor: John B. Kosmatka, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/475,749

(22) Filed: Dec. 30, 1999

(51) Int. Cl.[7] ..... A63B 53/04

(52) U.S. Cl. ..... 473/329; 473/345; 473/346; 473/349

(58) Field of Search ..... 473/324, 329, 473/332, 345, 346, 349, 350, 290, 291, 282, 131, 342, 347, 348, 288, 337

(56) References Cited

U.S. PATENT DOCUMENTS

| | | | |
|---|---|---|---|
| Re. 35,955 | * | 11/1998 | Lu . |
| 3,937,474 | | 2/1976 | Jepson et al. . |
| 3,975,023 | | 8/1976 | Inamori . |
| 3,989,248 | | 11/1976 | Campau . |
| 4,252,262 | | 2/1981 | Igarashi . |
| 4,326,716 | | 4/1982 | Lacoste . |
| 4,398,965 | | 8/1983 | Campau . |
| 4,498,672 | | 2/1985 | Bulla . |
| 4,824,110 | | 4/1989 | Kobayashi . |
| 4,826,172 | * | 5/1989 | Antonious . |
| 5,000,454 | | 3/1991 | Soda . |
| 5,026,056 | | 6/1991 | McNally et al. . |
| 5,067,715 | | 11/1991 | Schmidt et al. . |
| 5,106,094 | * | 4/1992 | Desbiolles . |
| 5,141,230 | | 8/1992 | Antonious . |
| 5,180,166 | | 1/1993 | Schmidt et al. . |
| 5,242,167 | | 9/1993 | Antonious . |
| 5,255,918 | | 10/1993 | Anderson et al. . |
| 5,261,663 | | 11/1993 | Anderson . |
| 5,288,070 | | 2/1994 | Chen . |
| 5,290,032 | | 3/1994 | Fenton et al. . |
| 5,299,807 | | 4/1994 | Hutin . |
| 5,301,941 | | 4/1994 | Allen . |
| 5,310,185 | | 5/1994 | Viollaz et al. . |
| 5,417,419 | | 5/1995 | Anderson et al. . |
| 5,431,396 | | 7/1995 | Shieh . |
| 5,458,334 | | 10/1995 | Sheldon et al. . |
| 5,460,371 | | 10/1995 | Takeda . |
| 5,464,211 | * | 11/1995 | Atkins . |
| 5,467,983 | * | 11/1995 | Chen . |
| 5,494,281 | | 2/1996 | Chen . |
| 5,499,814 | | 3/1996 | Lu . |
| 5,505,453 | | 4/1996 | Mack . |
| 5,524,331 | | 6/1996 | Pond . |
| 5,547,427 | * | 8/1996 | Rigal . |
| 5,586,947 | | 12/1996 | Hutin . |
| 5,586,948 | | 12/1996 | Mick . |
| 5,628,697 | | 5/1997 | Gamble . |
| 5,703,294 | | 12/1997 | McConnell et al. . |
| 5,743,813 | | 4/1998 | Chen et al. . |
| 5,797,807 | | 8/1998 | Moore . |
| 5,863,261 | | 1/1999 | Eggiman . |
| 5,873,791 | | 2/1999 | Allen . |
| 5,888,148 | | 3/1999 | Allen . |
| 5,890,973 | | 4/1999 | Gamble . |
| 5,908,356 | * | 6/1999 | Nagamoto . |
| 5,931,746 | * | 8/1999 | Soong . |
| 6,077,173 | * | 6/2000 | Stites . |

* cited by examiner

*Primary Examiner*—Sebastiano Passaniti
(74) *Attorney, Agent, or Firm*—Michael A. Catania

(57) ABSTRACT

A golf club having a club head with a thin, flexible striking plate for improved energy transfer to a golf ball also has a means for limiting the deflection of the striking plate during high speed impacts with the golf ball. A brace is positioned within the interior of the golf club head a predetermined distance from the striking plate to limit the deflection of the thin, flexible striking plate.

21 Claims, 9 Drawing Sheets

GOLF CLUB HEAD WITH AN INTERNAL STRIKING PLATE BRACE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a golf club head with an internal brace for limiting the deflection of the face at high impact speeds.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10–100 times larger than the damping properties of a metallic club face. Thus, during impact most of the energy is lost as a result of the high stresses and deformations of the golf ball (0.001 to 0.20 inches), as opposed to the small deformations of the metallic club face (0.025 to 0.050 inches). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S. Pat. No. 5,743,813 for a Golf Club Head, discloses using multiple layers in the face to absorb the shock of the golf ball. One of the materials is a non-metal material.

Yet another Campau invention, U.S. Pat. No. 3,989,248, for a Golf Club Having Insert Capable Of Elastic Flexing, discloses a wood club composed of wood with a metal insert.

Lu, U.S. Pat. No. 5,499,814, for a Hollow Club Head With Deflecting Insert Face Plate discloses a golf club head that has a reinforcing element positioned behind the face plate within an interior of a club head body that is filled with a polyurethane foam. A gap is maintained between the face plate and a support plate of the reinforcing element of the Lu invention. During impact with a golf ball, the face plate deflects until it engages the support plate whereupon the face plate is suddenly stopped and the full transfer of energy is made for the first time from the club head to the ball. The Lu invention has the face plate engage the support on every impact with a golf ball in order to reduce hooking and slicing.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e which measures club face COR. This USGA test procedure, as well as procedures like it, may be used to measure club face COR.

Although the prior art has disclosed many variations of golf club heads, the prior art has failed to provide a golf club head that manipulates the coefficient of restitution depending on the impact speed.

BRIEF SUMMARY OF THE INVENTION

The present invention provides a golf club head that is capable of imparting a very high coefficient of restitution for low swing speed golfers while imparting a high, yet lower, coefficient of restitution for high swing speed golfers. The present invention is able to accomplish this by using a striking plate composed of a thin material with a brace positioned behind the striking plate.

One aspect of the present invention is a golf club head having a body having a hollow interior, a striking plate and a brace. The striking plate has an exterior surface, an interior surface and a thickness in the range of 0.010 inches to 0.250 inches. The brace is disposed in the hollow interior of the body at least 0.010 inches from the interior surface of the striking plate. The brace is either fixed in a set position, or the brace is adjustable to modify its position in relation to the striking plate. The inward deflection of the striking plate is restricted by the brace. At an impact speed greater than 110 miles per hour, the golf club head has a coefficient of restitution less than 0.83 while at speed lower than 110 mile per hour the golf club head has a coefficient of restitution greater than 0.83. The coefficient of restitution is measured under test conditions, such as those specified by the USGA. The standard USGA conditions for measuring the coefficient of restitution is set forth in the USGA Procedure for Measuring the Velocity Ratio of a Club Head for Conformance to Rule 4-1e, Appendix II. Revision I, Aug. 4, 1998 and Revision 0, Jul. 6, 1998, available from the USGA.

Another aspect of the present invention is a golf club head having means for imparting a coefficient of restitution less than 0.83 at a first impact speed and imparting a coefficient of restitution greater than 0.83 at an impact speed lower than the first impact speed. The golf club head also has a striking plate that has an exterior surface, an interior surface and a thickness in the range of 0.010 inches to 0.250 inches. The imparting means may be a brace disposed within a body of the golf club head. The imparting means also strengthens the striking plate during high speed impacts to prevent failure.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
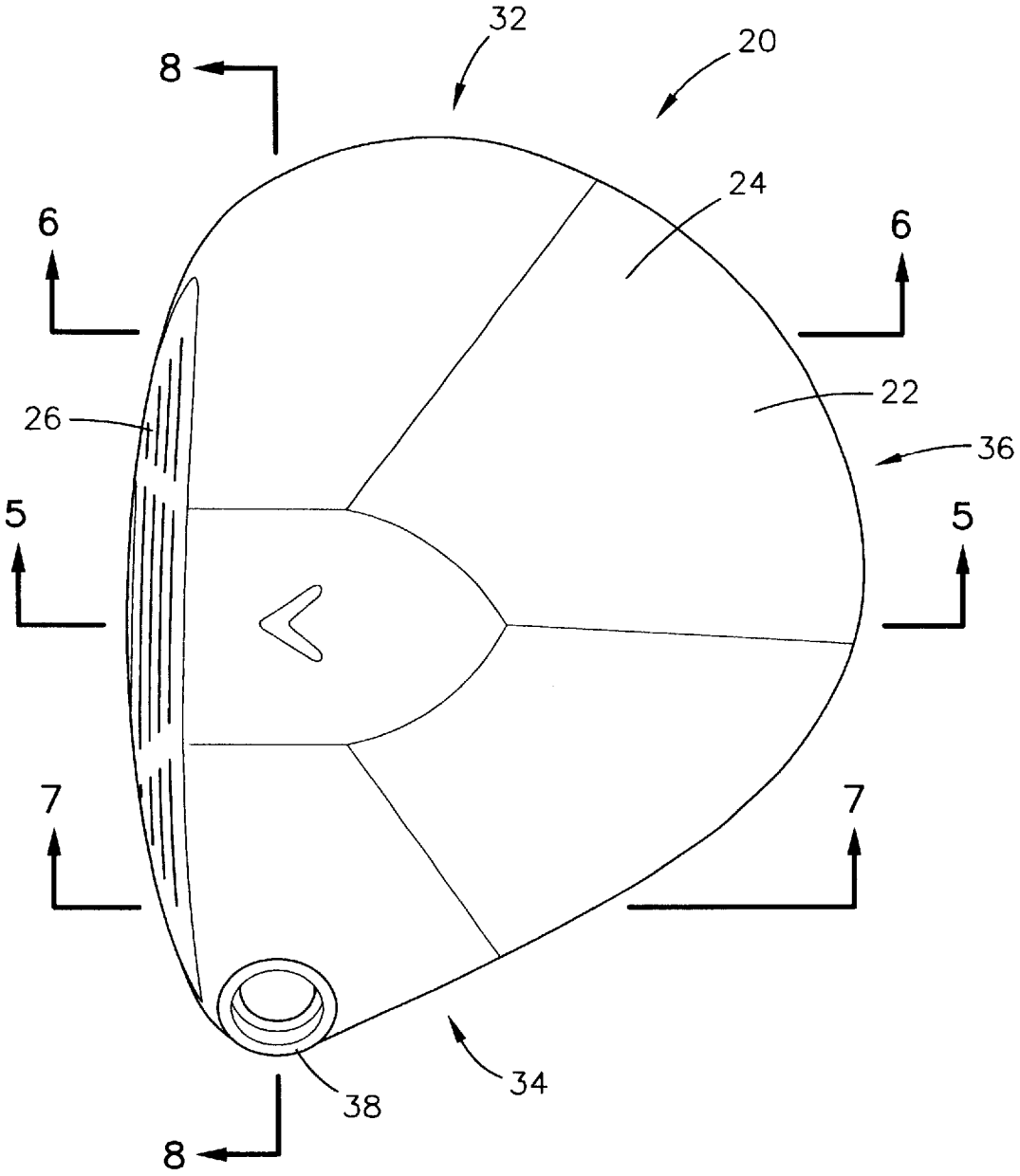
FIG. 1 is a top plan view of a golf club head of the present invention.
Figure 2:
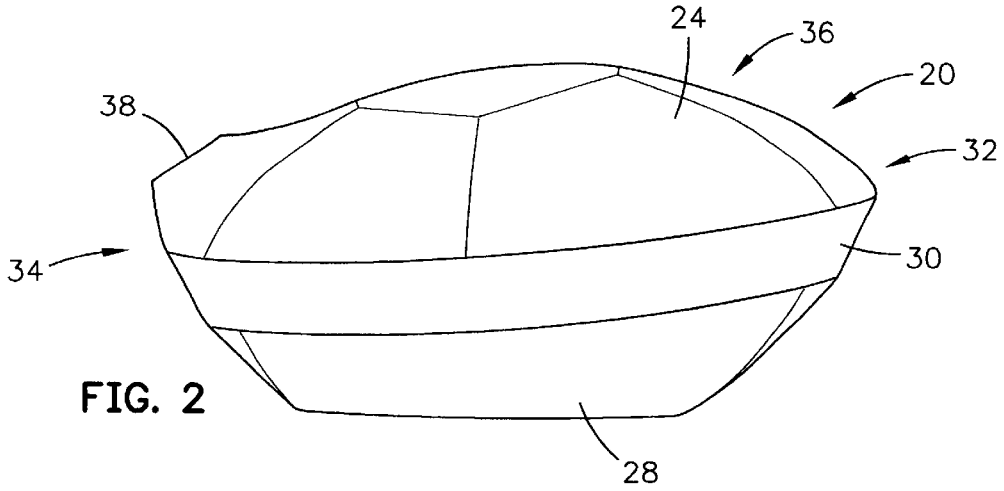
FIG. 2 is a rear view of the golf club head of FIG. 1.
Figure 3:
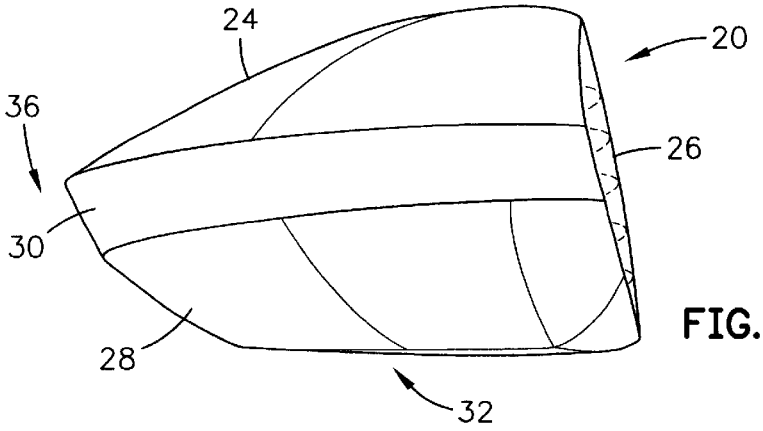
FIG. 3 is a toe end view of the golf club head of FIG. 1.
Figure 4:
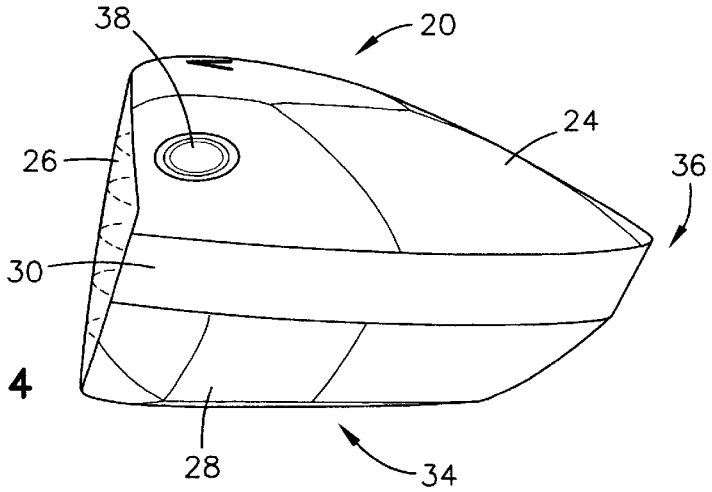
FIG. 4 is a heel end view of the golf club head of FIG. 1.
Figure 5:
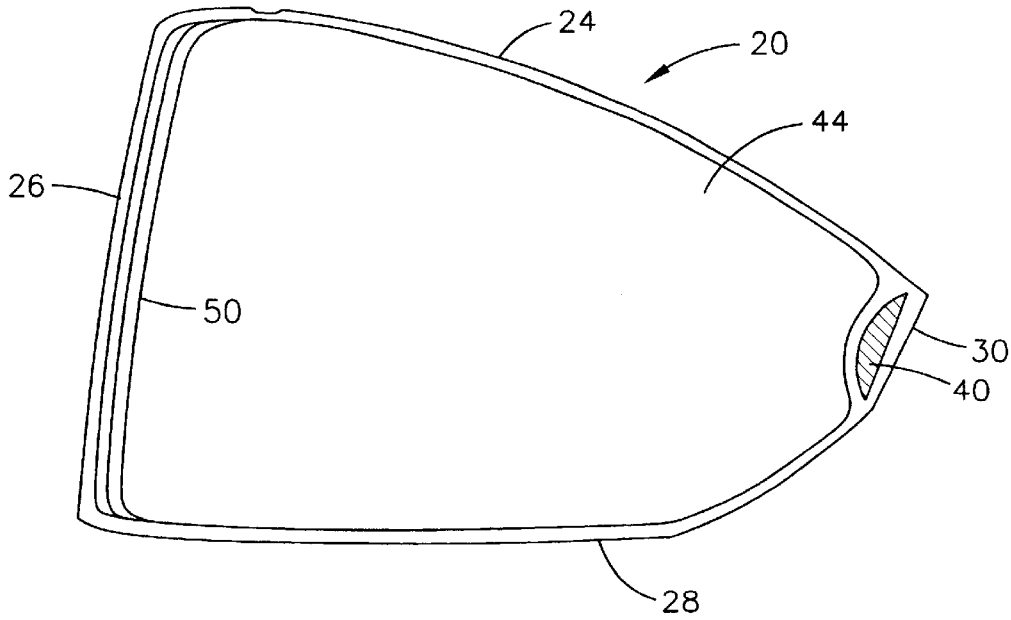
FIG. 5 is a cross-sectional view of the golf club head of FIG. 1 along line 5—5.
Figure 6:
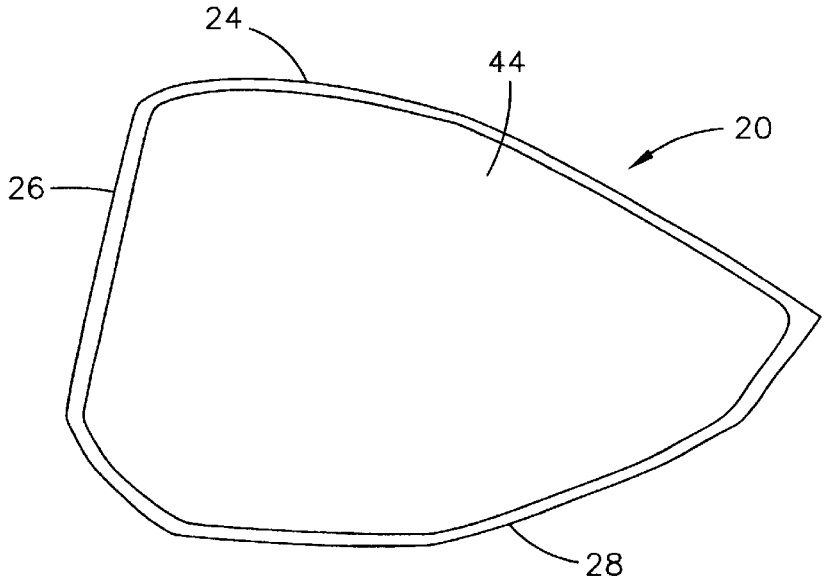
FIG. 6 is a cross-sectional view of the golf club head of FIG. 1 along line 6—6.
Figure 7:
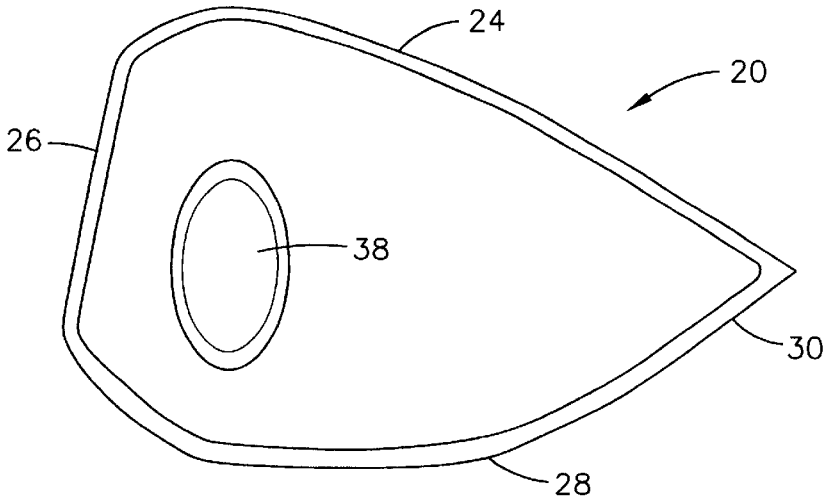
FIG. 7 is a cross-sectional view of the golf club head of FIG. 1 along line 7—7.
Figure 8:
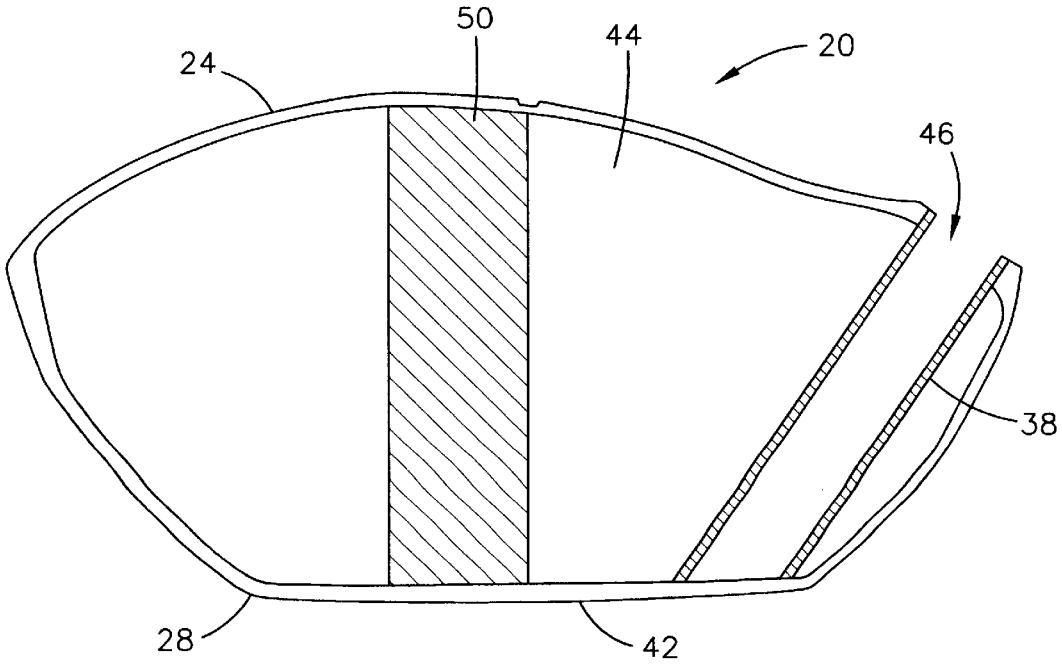
FIG. 8 is a cross-sectional view of the golf club head of FIG. 1 along line 8—8.

The present invention is directed at a golf club head having a striking plate that is thin and has a high coefficient of restitution thereby enabling for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face. The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a striking plate or face with a coefficient of restitution approaching 0.93 for low swing speed golfers, as measured under conventional test conditions. However, the coefficient of restitution is less than or equal to 0.83 for high swing speed golfers. High swing speed golfers are defined as golfers with a swing speed of 110 miles per hour or greater.

As shown in FIGS. 1–4, a golf club head 20 has a body 22. Engaging the club head 20 is a shaft that has a grip, not shown, at a butt end and is inserted into a hosel 38 at a tip end. An O-ring may encircle the shaft at an aperture 39 to the hosel 38.

The body 22 generally includes three sections, a crown 24, a striking plate 26 and a sole 28. The body 22 has a ribbon 30 juxtaposed by the crown 24 and the sole 28. The club head 20 may also be partitioned into a heel section 34 nearest the shaft, a toe section 32 opposite the heel section 34, and a rear section 36 opposite the striking plate 26.

As shown in FIGS. 5–9, the body has a hollow interior 44. Positioned inside the hollow interior 44 is a brace 50. The brace 50 limits the deflection of the striking plate 26 during high speed swings as described in greater detail below. The brace 50 is centrally positioned behind the striking plate 26, and extends in length from the crown 24 to the sole 28. In a preferred embodiment, the brace 50 need only extend in width about the center of the striking plate 26. However, in an alternative embodiment, the brace 50 could extend along the entire width of the striking plate 26 from the heel section 34 to the toe section 32 thereby essentially creating a second striking plate. Preferably, the brace 50 is composed of a stainless steel material and is positioned between 0.015 inches to 0.060 inches from the interior surface of the striking plate 26. However, those skilled in the pertinent art will recognize that the brace may be composed of other materials such as non-steel metals and high strength composites or plastics without departing from the scope and spirit of the present invention.

Figure 9:
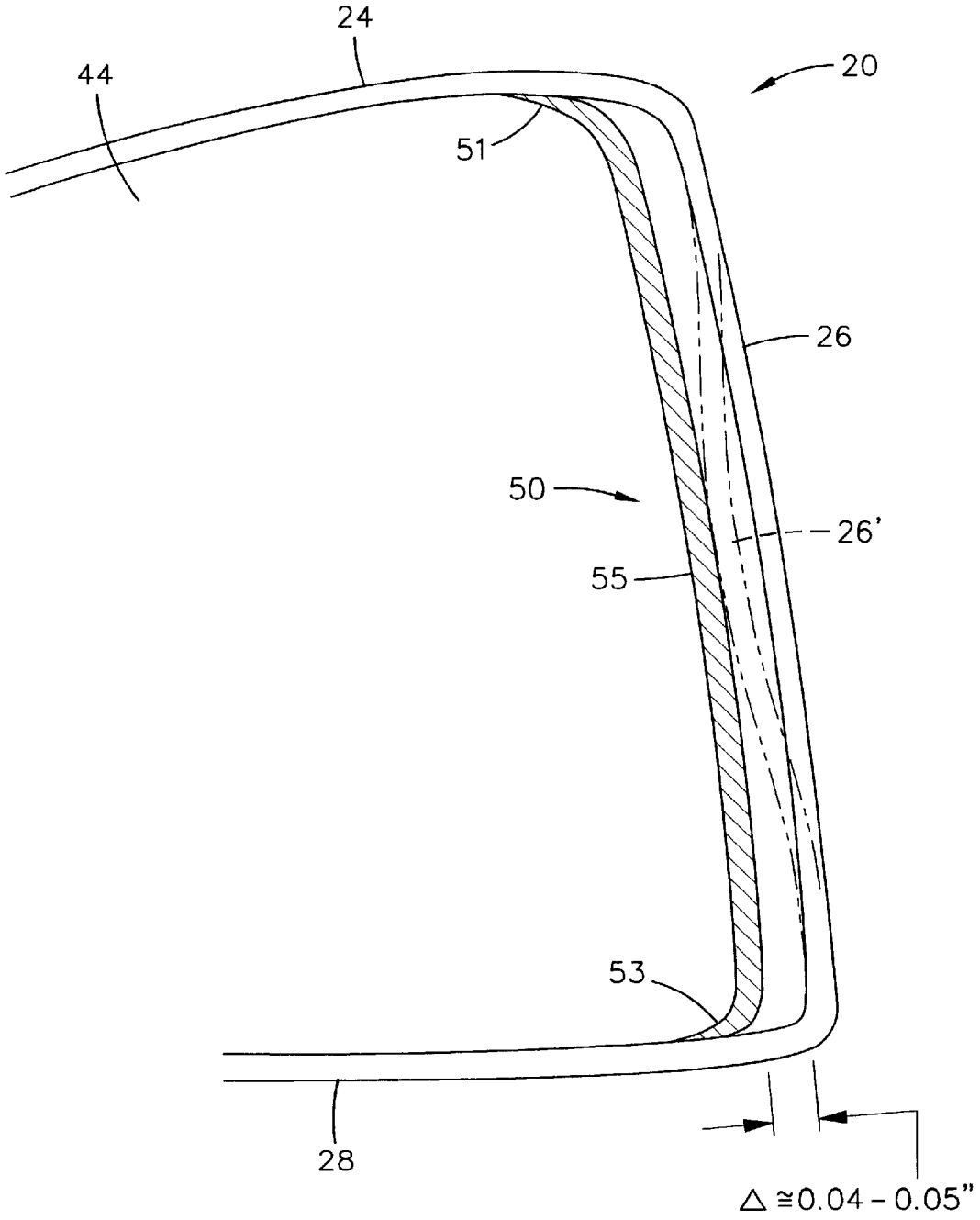
FIG. 9 is an isolated cross-section view of the striking plate and brace of the present invention.
Figure 10:
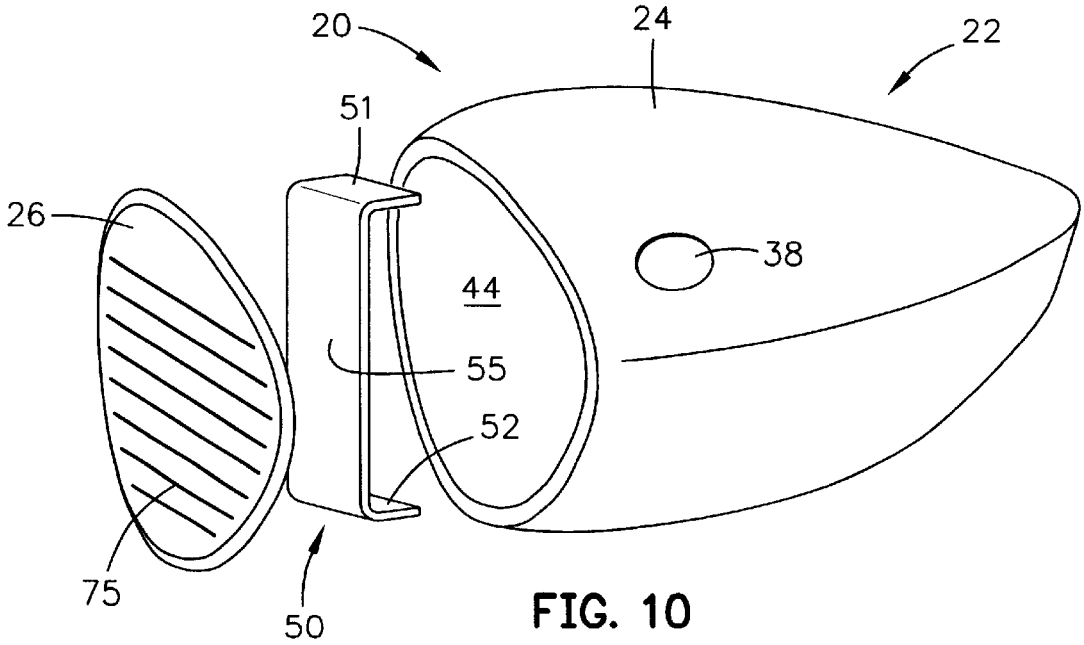
FIG. 10 is an exploded view of the golf club head of the present invention.

As shown in FIGS. 9 and 10, the brace 50 has a U-shape with top and bottom ends 51 and 53 perpendicular to a main body 55. The top and bottom ends 51 and 53 may be welded to the crown 24 and sole 28, respectively.

Figure 11:
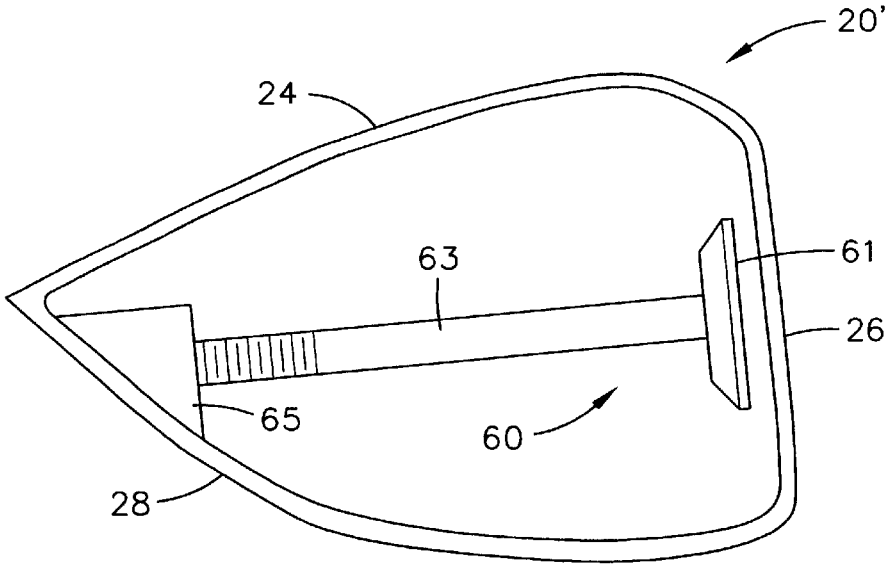
FIG. 11 is a cross-section view of an alternative embodiment of the club head of the present invention.

An alternative embodiment of the present invention is illustrated in FIG. 11. In this embodiment, a limiting means 60 has a front brace 61 connected to a rod 63. The rod is connected to a mounting member 65 that is attached to the sole 28. The distance of the front brace 61 from the interior surface of the striking plate 26 is still within the range of 0.015 inches to 0.060 inches.

The striking plate 26 is generally composed of a single piece of metal, and is preferably composed of a forged metal material. More preferably, the forged metal material is a forged titanium material. However, those skilled in the relevant art will recognize that the face member may be composed of other materials such as steels, vitreous metals, ceramics, composites, carbon, carbon fibers and other fibrous materials without departing from the scope and spirit of the present invention. The striking plate 26 has a plurality of scorelines 75 thereon. The striking plate 26 may be cast with the body 24, or it may be welded to the body 24.

In an alternative embodiment, the striking plate 26 is composed of a vitreous metal such as iron-boron, nickel-copper, nickel-zirconium, nickel-phosphorous, and the like. These vitreous metals allow for the striking plate 26 to have a thickness as thin as 0.055 inches. Preferably, the thinnest portions of such a vitreous metal striking plate 26 would be in the periphery regions 110*a* and 110*b,* although the entire striking plate 26 of such a vitreous metal striking plate 26 could have a uniform thickness of 0.055 inches.

Yet in further alternative embodiments, the striking plate 26 is composed of ceramics, composites or other metals. Additionally, the thinnest regions of the striking plate 26 may be as low as 0.010 inches allowing for greater compliance and thus a higher coefficient of restitution.

The coefficient of restitution of the club head 20 of the present invention under standard USGA test conditions with a given ball ranges from 0.80 to 0.83 since the USGA test conditions require a swing speed of 110 mph. However, the coefficient of restitution of the club head 20 of the present invention is greater than 0.83 for swing speeds less than 110 mph. The club head 20 also prevents damage from high speed impacts with a golf ball which may result in failure of the striking plate 26.

Figure 12:
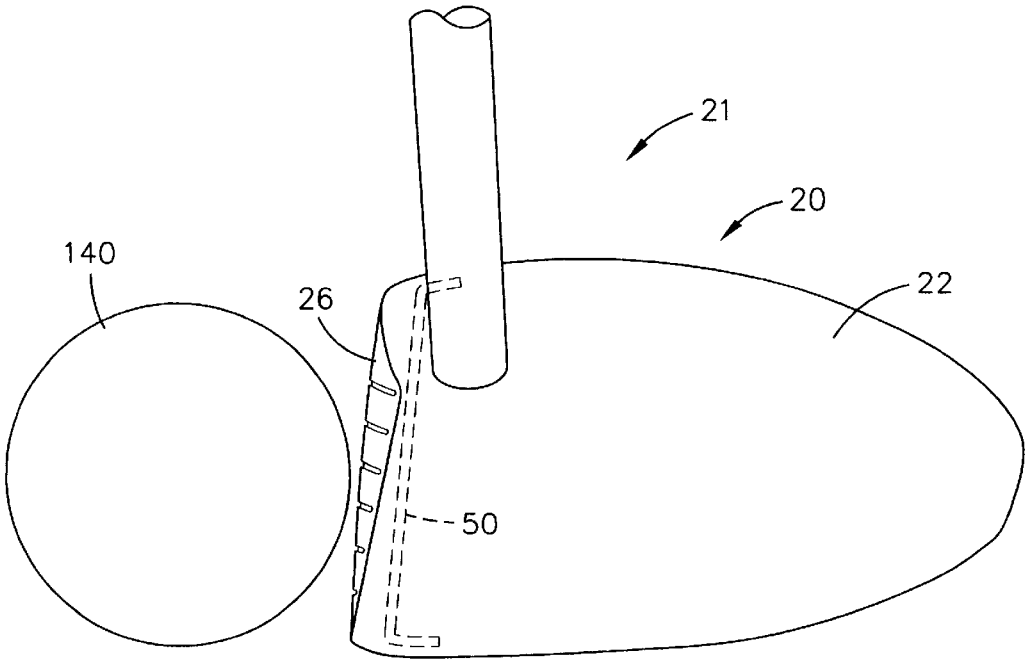
FIG. 12 is a side view of a golf club head of the present invention immediately prior to low swing speed impact with a golf ball.
Figure 13:
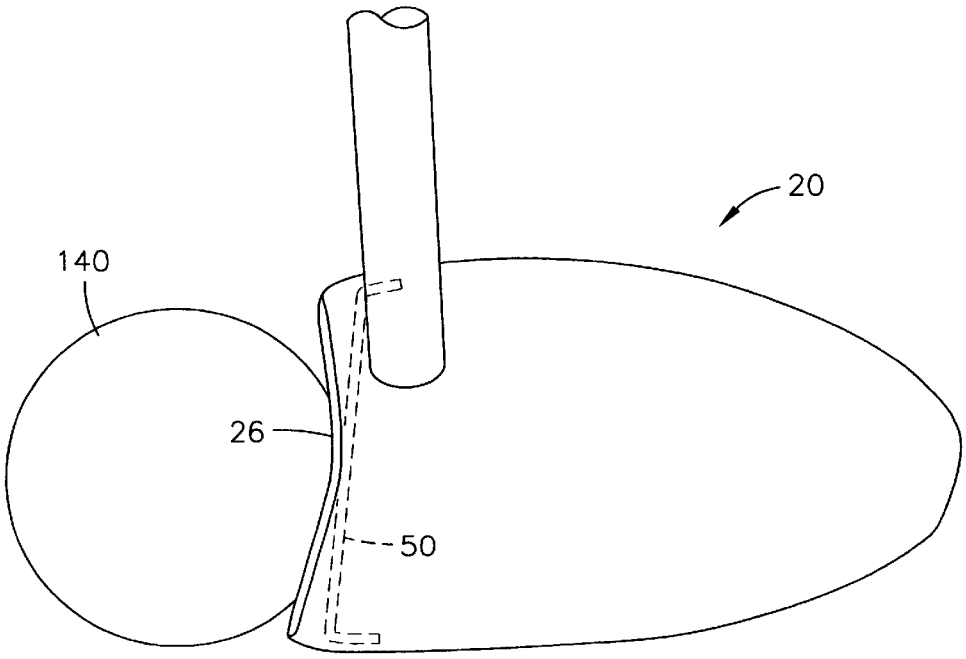
FIG. 13 is a side view of a golf club head of the present invention during low swing speed impact with a golf ball.
Figure 14:
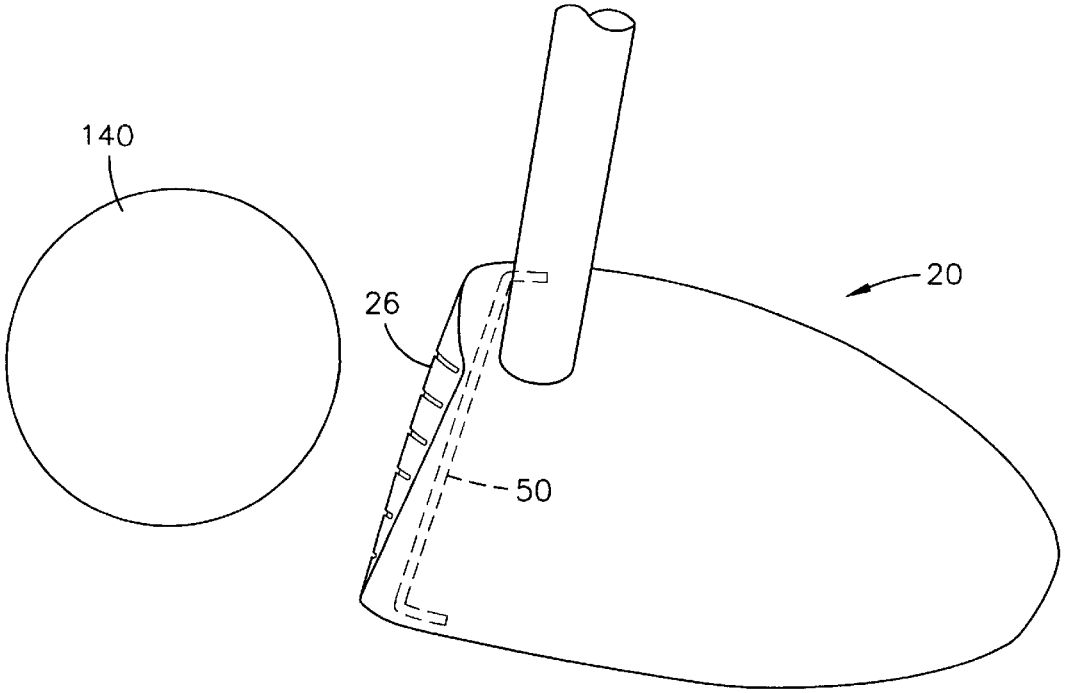
FIG. 14 is a side view of a golf club head of the present invention immediately after low swing speed impact with a golf ball.
Figure 15:
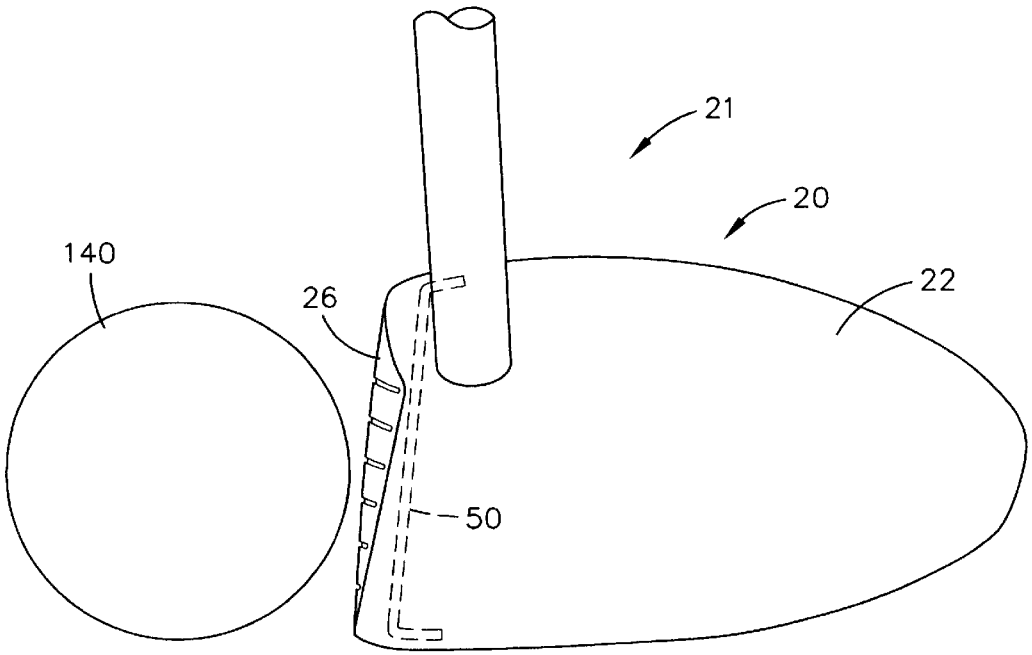
FIG. 15 is a side view of a golf club head of the present invention immediately prior to low swing speed impact with a golf ball.
Figure 16:
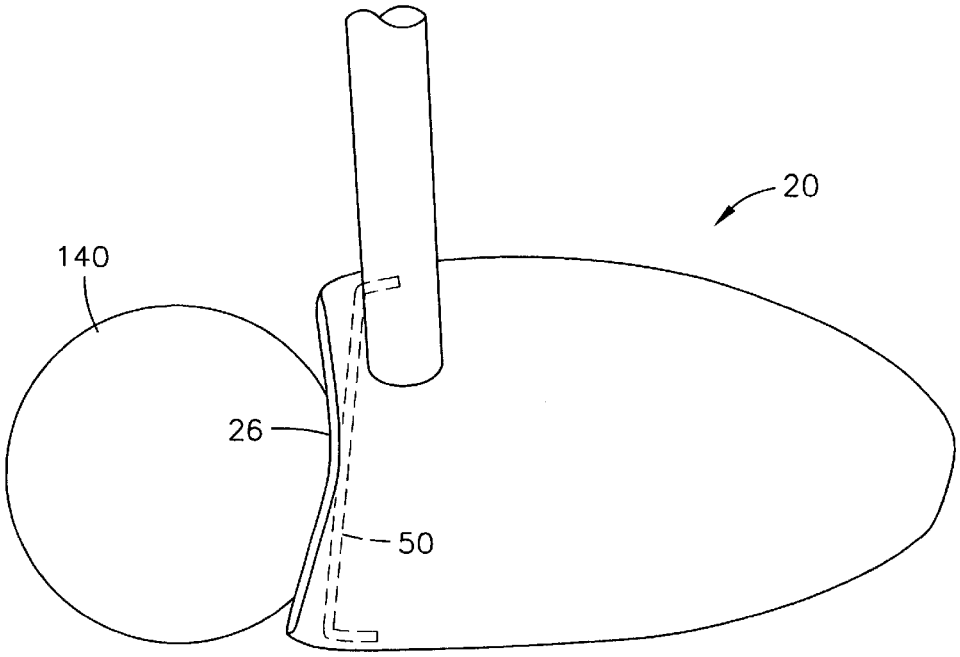
FIG. 16 is a side view of a golf club head of the present invention during low swing speed impact with a golf ball.
Figure 17:
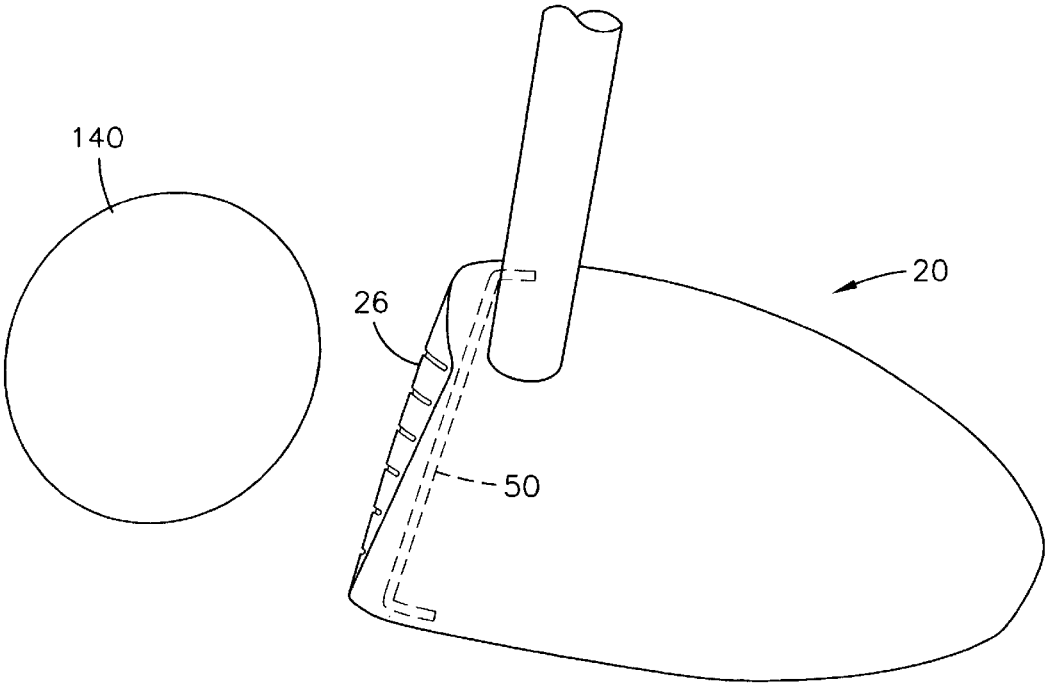
FIG. 17 is a side view of a golf club head of the present invention immediately after low swing speed impact with a golf ball.

As shown in FIGS. 12–17, the flexibility of the striking plate 26 allows for a greater coefficient of restitution at low swing speeds while limiting the coefficient of restitution at high swing speeds. FIGS. 12–14 illustrate a low swing speed. At FIG. 12, the striking plate 26 is immediately prior to striking a golf ball 140. At FIG. 13, the striking plate 26 is engaging the golf ball, and deformation of the golf ball 140 and striking plate 26 is illustrated. At FIG. 14, the golf ball 140 has just been launched from the striking plate 26. FIGS. 15–17 illustrate a high swing speed. At FIG. 15, the striking plate 26 is immediately prior to striking a golf ball 140. At FIG. 16, the striking plate 26 is engaging the golf ball, and deformation of the golf ball 140 and striking plate 26 is illustrated. The striking plate 26 is restrained from further deflection by the brace 50, and the brace 50 increases the deformation of the golf ball 140 relative to the deformation at a low swing speed. The greater deformation of the golf ball 140 leads to a greater loss of energy thereby reducing the coefficient of restitution. At FIG. 17, the golf ball 140 has just been launched from the striking plate 26.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf club head comprising:

a body having a hollow interior;

a striking plate having an exterior surface, an interior surface and a thickness in the range of 0.010 inch to 0.250 inch; and a brace disposed in the hollow interior of the body, the brace being centrally positioned behind the striking plate extending in length from the crown to the sole, having a width less than the width of the striking plate, and disposed at least 0.015 inch from the interior surface of the striking plate wherein the inward deflection of the striking plate is restricted by the brace.

2. The golf club head according to claim 1 wherein the striking plate has a thickness in the range of 0.055 to 0.125 inch.

3. The golf club head according to claim 1 wherein the striking plate has a thickness in the range of 0.0110 to 0.060 inch.

4. The golf club head according to claim 1 wherein the striking plate is composed of a material selected from the group consisting of titanium, titanium alloys, steels, vitreous metals, ceramics, composites, carbon materials, carbon fiber materials, other fibrous materials and mixtures thereof.

5. The golf club head according to claim 1 wherein the brace is composed of a stainless steel material.

6. The golf club head according to claim 1 wherein the brace is disposed at least 0.040 inch from the interior surface of the striking plate.

7. The golf club head according to claim 1 wherein the brace is disposed at least 0.050 inch from the interior surface of the striking plate.

8. The golf club head according to claim 1 wherein the brace is disposed less than 0.060 inch from the interior surface of the striking plate.

9. The golf club head according to claim 1 wherein the club head is selected from the group consisting of woods and irons.

10. The golf club head according to claim 1 wherein the brace is attached to a crown section of the body on one end and a sole section of the body on an opposite end.

11. The golf club head according to claim 1 wherein the brace is mounted and on a rear wall of the body opposite the striking plate.

12. The golf head according to claim 10 wherein the brace is positioned in relation to the center of the striking plate and has a length extending from the crown section to the sole section.

13. The golf head according to claim 11 wherein the brace is positioned in relation to the center of the striking plate and has a length less than the length of the striking plate.

14. A golf club head comprising:

a striking plate having an exterior surface, an interior surface and a thickness in the range of 0.010 inch to 0.250 inch; and means for imparting a coefficient of restitution less than 0.83 an impact speed greater than 110 mph and imparting a coefficient of restitution greater than 0.83 at an impact speed less than 110 mph said means for imparting a coefficient of restitution being centrally positioned behind the striking plate, extending in length from the crown to the sole, and having a width less than the width of the striking plate.

15. The golf club head according to claim 14 wherein the imparting means is a brace disposed within a body of the golf club head.

16. The golf club head according to claim 15 wherein the brace is disposed at least 0.015 inch from an interior surface of the striking plate wherein the inward deflection of the striking plate is restricted by the brace.

17. The golf club head according to claim 16 wherein the brace is attached to a crown section of the body on one end and a sole section of the body on an opposite end.

18. The golf club head according to claim 16 wherein the brace is mounted and on a rear wall of the body opposite the striking plate.

19. The golf head according to claim 17 wherein the brace is positioned in relation to the center of the striking plate and has a length extending from the crown section to the sole section.

20. The golf head according to claim 18 wherein the brace is positioned in relation to the center of the striking plate and has a length less than the length of the striking plate.

21. The golf club head according to claim 14 wherein the golf club head has a coefficient of restitution of at least 0.87 for the impact speed lower than the first impact speed.

* * * * *